United States Patent [19]

Chamberlain

[11] 4,095,071

[45] June 13, 1978

[54] SWITCH MOUNTED IN A LEVER HANDLE

[75] Inventor: Richard W. Chamberlain, Aurora, Ill.

[73] Assignee: Caterpillar Tractor Co., Peoria, Ill.

[21] Appl. No.: 704,133

[22] Filed: Jul. 12, 1976

[51] Int. Cl.[2] ..... H01H 9/06

[52] U.S. Cl. ..... 200/157; 200/153 R; 200/330; 200/339

[58] Field of Search ..... 200/157, 339, 330, 153, 200/327, 336, 335

[56] References Cited

U.S. PATENT DOCUMENTS

| | | | |
|---|---|---|---|
| 1,887,274 | 11/1932 | Mayer | 200/335 |
| 2,183,310 | 12/1939 | Frantz | 200/157 |
| 2,543,450 | 2/1951 | Feagin | 200/157 X |
| 2,812,405 | 11/1957 | Wolkou | 200/157 |
| 3,086,090 | 4/1963 | Carroll | 200/303 X |
| 3,283,088 | 11/1966 | Scow et al. | 200/157 X |
| 3,654,415 | 4/1972 | Hawkins | 200/157 X |
| 3,715,544 | 2/1973 | Duve | 200/157 |
| 3,959,618 | 5/1976 | Carroll | 200/339 |
| 3,974,347 | 8/1976 | Lockard | 200/339 |

*Primary Examiner*—Harold Tudor
*Attorney, Agent, or Firm*—Phillips, Moore, Weissenberger, Lempio & Majestic

[57] ABSTRACT

A control lever for a machine or the like includes a grip or handle for a control member defining a housing for mounting a switch and includes a thumb actuated rocking actuator positioned on the top of the grip for ease of actuation by the thumb of an operator while grasping the handle of the control lever.

2 Claims, 2 Drawing Figures

SWITCH MOUNTED IN A LEVER HANDLE

BACKGROUND OF THE INVENTION

The present invention relates generally to electrical switches and pertains particularly to an electrical switch mounted in the hand grip of a control lever.

Many industrial machines such as hydraulic excavators, for example, employ a number of control elements including separate hand manipulated levers for controlling the many functions of the machine. Such excavators also frequently include many control functions which are of an intermittent nature and are fairly infrequently used, but which must be actuated simultaneously with or during the actuation of a second control member. For this reason, the control of such systems must be so positioned as to be accessible by the operator while he is busy with another function.

While the mounting of control elements such as switches on or near the grip or handle of control levers is known, many such control arrangements are unsatisfactory for various reasons. For example, some are so constructed and positioned as to be accidentally activated without intent by the operator. Others are so positioned as to be difficult to be actuated while maintaining control of the control lever.

The prior art approach to the combining of levers and switches are shown for example in U.S. Pat. No. 1,973,831, issued Sept. 18, 1934 to Waggoner; and U.S. Pat. No. 3,931,486, issued Jan. 6, 1976 to Raetz. These patents, however, suffer from the aforementioned disadvantages.

Other patents which although not recognizing the applicant's problem or his solution are of some interest in regard thereto are U.S. Pat. No. 2,095,922, issued Oct. 12, 1937 to Creahan; U.S. Pat. No. 2,788,405, issued Apr. 9, 1957 to Benquet; and U.S. Pat. No. 3,217,112, issued Nov. 9, 1965 to Campbell, et al.

SUMMARY AND OBJECTS OF THE INVENTION

It is the primary object of the present invention to overcome the above problems of the prior art.

It is another object of the present invention to provide a combined switch and lever wherein the switch is easily actuatable while the grip is held in the normal manner.

A further object of the present invention is to provide grip means for mounting an electrical switch and actuator means for the switch that permits the grip to be held in the normal manner without accidentally actuating the switch, yet provide easy and readily available access to the switch actuating means.

In accordance with the primary aspect of the present invention, a grip for a control member defines housing means for mounting an electrical switch and includes a rocking thumb actuator for easily actuating the switch while the grip is being held in a normal manner.

BRIEF DESCRIPTION OF THE DRAWING

The above and other objects and advantages of the present invention will become apparent from the following description when read in conjunction with the drawings wherein.

DETAILED DESCRIPTION OF A PREFERRED EMBODIMENT

Figure 1:
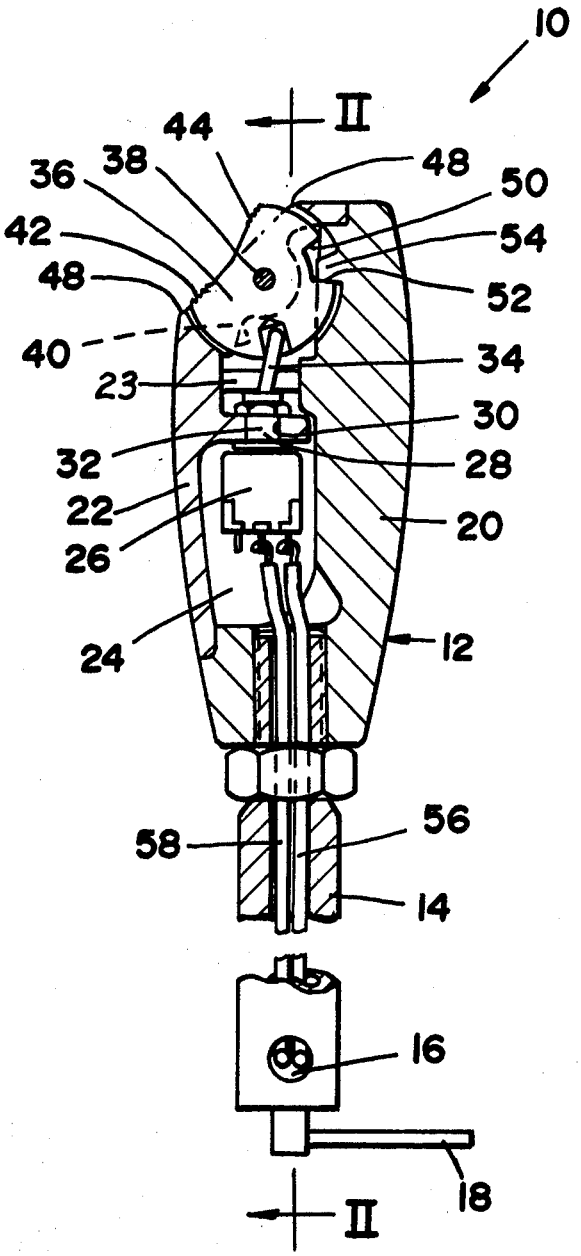
FIG. 1 is an elevational view in section of a control lever grip embodying the present invention.
Figure 2:
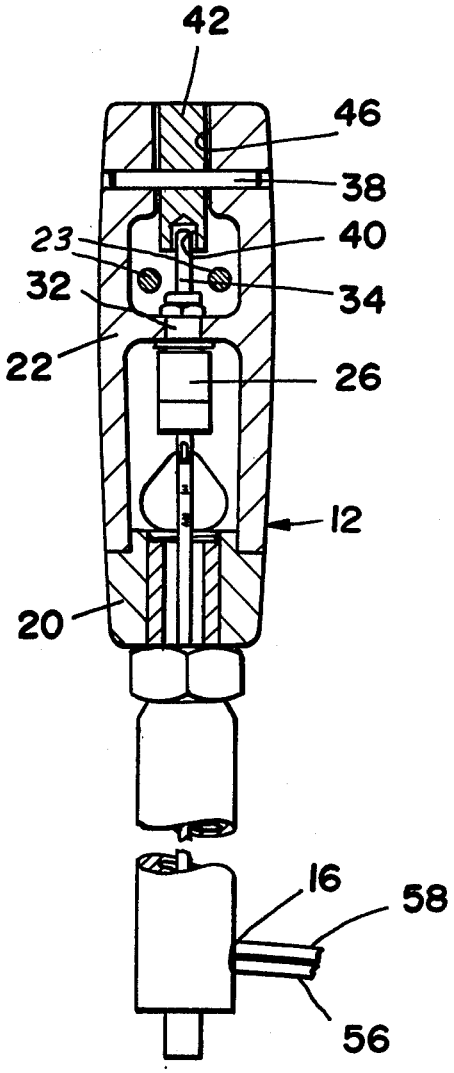
FIG. 2 is a view generally along lines II—II of FIG. 1.

Referring now to the drawing and particularly FIG. 1, a combined grip and switch assembly in accordance with the present invention is indicated generally by the numeral 10. The grip 12 in mounted in a suitable manner on the upper end of a control lever 14 which is pivotally mounted in its lower end by suitable pivot pin means 16 and is connected by suitable like means 18 for actuating a valve or other remote element or the like.

The grip 12 includes a first or front member 20 defining the front portion of the grip to be engaged by the fingers of an operator and a rear or second member 22 defining a rear of the grip to be engaged by the heel of the hand of an operator when grasping the grip normally. The members 20 and 22 are releasably secured to one another by a plurality of screws 23. The grip means defines a housing generally having a cavity 24 in which a switch 26 is mounted. The switch includes an upper neck portion 28 extending through a bore 30 of a bracket 32 in the member 22 for mounting the switch thereto. A switch actuator 34 extends upward from the switch 26 and is movable to and fro for movement of the switch to the on and off positions. A rocking or rotary thumb wheel 36 is mounted on suitable pin means 38 and includes a notch 40 extending radially thereinto for receiving the actuator arm or lever 34. The disc or thumbwheel 36 includes a substantially V-shaped configuration defining a pair of notched surfaces 42 and 44 for engagement with the thumb for actuation of the thumbwheel and the switch 26. These notched surfaces 42 and 44 alternately extend through and above or flush with a slot 46 and surrounding surface 48 on the upper end of the grip 12.

Thus it is seen that when the thumbwheel is rotated to the position as shown where surface 42 is flush with surface 48, the switch is in one position of actuation whereupon movement of the thumbwheel to the position where surface 44 is flush with surface 48 the switch actuator 34 is moved to a position opposite that previously described.

A slot extends across the thumbwheel 36 and defines a pair of shoulders 50 and 52 which engage shoulders of a stop member or projection 54. This defines the extreme positions of rotation of the thumbwheel 36 and the respective on and off positions of the switch 26.

The switch 26 is of a substantially conventional design and as illustrated is connected by suitable conductors 56 and 58 for actuating some remote control element not shown. It will be appreciated that the location of the thumbwheel 36 directly above the rear portion of the grip 12 is such that the thumb of the operator can extend directly upward thereto while the hand grasps the grip 12 in the normal manner. Thus the operator can simply wrap his fingers around the grip in the normal manner with the thumb extending likewise around the opposite side for gripping and manipulating the control lever 14. However, upon movement of the thumb upward to its upward position, he can still maintain a grip or grasp on 12 for manipulating the control lever 14 while at the same time actuate the switch 26 by rotation of thumbwheel 36 to either one of the on or off positions. This provides a human engineered grip device which is simple and economical to construct and which is easy and convenient to operate.

While the present invention has been described by means of a single embodiment, it is to be understood that numerous changes and modifications may be made therein without departing from the spirit and scope of the invention as defined in the appended claims.

What is claimed is:

1. A combined lever and switch control assembly, comprising:

(a) a lever having means for defining a hollow housing at an upper end of said lever for gripping by the hand of an operator, said housing having an elongated front member extending along said lever and shaped to be gripped by the fingers of a hand, an elongated rear member extending along said lever and shaped to be gripped by the heel of a hand, and means for releasably securing said front member to said rear member, said rear member having a sloping top surface;

(b) switch means for operating a remote member, including a toggle switch mounted within said housing on said rear member and having a movable arm extending upwardly inside said housing;

(c) thumb controlled means, rotatably mounted on said rear member, for actuating said toggle switch, including means for receiving said arm to move said arm, and first and second surfaces alternately extending above and flush with said top sloping surface for ease of actuation by the thumb of a hand, said thumb controlled means being rotatably mounted to permit a pushing action on either said first surface or said second surface to change the state of said toggle switch; and (d) means for stopping rotary movement of said thumb controlled means when said toggle switch is in either state, including a fixed projection extending from said front member internally of said housing, and a pair of spaced-apart shoulders on said thumb controlled means straddling said projection, either of said shoulders contacting said projection depending on the direction of rotation of said thumb controlled means.

2. A control assembly according to claim 1 wherein said thumb controlled means comprises a disk rotatable about its axis, wherein said receiving means includes a notch extending radially into said disk, and wherein said first and said second surfaces are notched and form a V-shaped on said disk.

* * * * *